US011390095B2

(12) United States Patent
Takanashi et al.

(10) Patent No.: US 11,390,095 B2
(45) Date of Patent: Jul. 19, 2022

(54) PRINTING APPARATUS AND METHOD OF POSITIONING ULTRAVIOLET IRRADIATION PART

(71) Applicant: SEIKO EPSON CORPORATION, Tokyo (JP)

(72) Inventors: Ko Takanashi, Matsumoto (JP); Naoyuki Okumura, Shimosuwa-cho (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/877,060

(22) Filed: May 18, 2020

(65) Prior Publication Data

US 2020/0369052 A1 Nov. 26, 2020

(30) Foreign Application Priority Data

May 20, 2019 (JP) ..... JP2019-094579

(51) Int. Cl.

| | |
|---|---|
| ***B41J 2/01*** | (2006.01) |
| ***B41J 11/00*** | (2006.01) |
| ***B41J 25/00*** | (2006.01) |
| ***B41J 29/38*** | (2006.01) |

(52) U.S. Cl.

CPC .... *B41J 11/00214* (2021.01); *B41J 11/00212* (2021.01); *B41J 11/00218* (2021.01); *B41J 25/001* (2013.01); *B41J 29/38* (2013.01)

(58) Field of Classification Search

None

See application file for complete search history.

(56) References Cited

U.S. PATENT DOCUMENTS

2009/0303710 A1* 12/2009 Lin ..... F21V 7/10 362/232
2016/0167399 A1* 6/2016 Ohnishi ..... B41J 2/01 347/102
2016/0279950 A1* 9/2016 Sugaya ..... B41J 29/00
2019/0105930 A1* 4/2019 Date ..... H04N 1/40056

FOREIGN PATENT DOCUMENTS

JP 2016-196163 11/2016

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing apparatus includes a supporting part for a printing medium, a head, an ultraviolet irradiation part that emits from an irradiation surface thereof ultraviolet light, a protrusion fixed to the ultraviolet irradiation part, a frame, an attaching part that is attachable to the frame with an attaching position thereof adjusted, and a guide part that is attachable to the frame and guides the adjustment of the attaching position of the attaching part with respect to the frame. The guide part includes first and second butted parts, and the attaching part includes a butting part having a width smaller than a spacing between the first and second butted parts, and a distance between the irradiation surface and the supporting part is a sum of a difference between the width of the butting part and the spacing and a protruding length of the protrusion from the irradiation surface.

4 Claims, 12 Drawing Sheets

PRINTING APPARATUS AND METHOD OF POSITIONING ULTRAVIOLET IRRADIATION PART

The present application is based on, and claims priority from JP Application Serial Number 2019-094579, filed May 20, 2019, the disclosure of which is hereby incorporated by reference herein in its entirety.

BACKGROUND

1. Technical Field

The present disclosure relates to a printing apparatus and a method of positioning an ultraviolet irradiation part.

2. Related Art

In the related art, a printing apparatus is used in which ultraviolet-curable ink is discharged from a head, and the ink is cured by irradiating the ink with ultraviolet light from an ultraviolet irradiation part so as to form an image on a printing medium that is being transported. In such a printing apparatus, when the ultraviolet light emitted from the ultraviolet irradiation part reaches the head, the ink at the nozzle of the head may be cured and the discharge stability may be reduced. Therefore, in such a printing apparatus, the ultraviolet irradiation part is highly accurately positioned using a specialized jig or the like to prevent the ultraviolet light emitted from the ultraviolet irradiation part from reaching the head. For example, JP-A-2016-196163 discloses a printing apparatus in which a blocking member is provided in an ultraviolet irradiation unit to reduce the ultraviolet light that reaches the print head from the ultraviolet irradiation unit.

By providing a blocking member as in the printing apparatus of JP-A-2016-196163, it is possible to reduce the ultraviolet light that reaches the head from the ultraviolet irradiation part. However, when the positioning accuracy of the ultraviolet irradiation part is low, the ultraviolet light emitted from the ultraviolet irradiation part may reach the head even with a blocking member. As such, in the related art, the positioning accuracy of the ultraviolet irradiation part has been increased using a specialized jig or the like as described above. However, the use of a specialized jig or the like increases task and cost, and therefore, it is desired to achieve simple and highly accurate positioning of the ultraviolet irradiation part.

SUMMARY

A printing apparatus according to an embodiment of the present disclosure for solving the above-described problems includes a supporting part for a printing medium, a head provided at a position opposite the supporting part and configured to discharge ultraviolet-curable ink to the printing medium, an ultraviolet irradiation part disposed at a position opposite the supporting part such that a direction along a width direction of the printing medium is a longitudinal direction of the ultraviolet irradiation part, the ultraviolet irradiation part being configured to irradiate, with ultraviolet light from an irradiation surface thereof, the printing medium on which the ink is discharged, a protrusion fixed to the ultraviolet irradiation part and protruding further toward the supporting part side than the irradiation surface does, a frame configured to support the ultraviolet irradiation part, and an attaching position adjustment part for attachment position adjustment of the ultraviolet irradiation part with respect to the frame, the attaching position adjustment part including an attaching part fixed to the ultraviolet irradiation part and attachable to the frame with an attaching position thereof adjusted and a guide part attachable to the frame and configured to guide the adjustment of the attaching position of the attaching part with respect to the frame. The guide part includes a first butted part and a second butted part disposed at a position opposite the first butted part, the second butted part being provided further toward the supporting part side than the first butted part is, and the attaching part includes a butting part located between the first butted part and the second butted part in an opposing direction in which the first butted part and the second butted part are opposite each other, the butting part having a width smaller than a spacing between the first butted part and the second butted part, and a distance between the irradiation surface and the supporting part is a sum of a difference between the width of the butting part and the spacing in the opposing direction and a protruding length of the protrusion from the irradiation surface.

DESCRIPTION OF EXEMPLARY EMBODIMENTS

Figure 1:
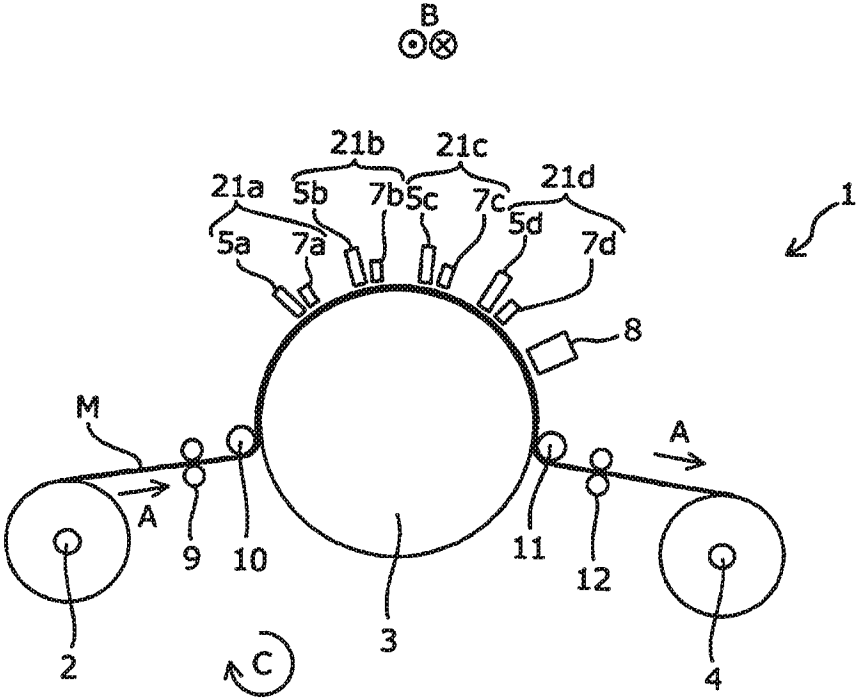
FIG. 1 is a schematic side view of a printing apparatus according to Example 1 of the present disclosure.

First, the present disclosure is schematically described.

A printing apparatus according to a first aspect of the present disclosure for solving the above-described problem includes a supporting part for a printing medium, a head provided at a position opposite the supporting part and configured to discharge ultraviolet-curable ink to the printing medium, an ultraviolet irradiation part disposed at a position opposite the supporting part such that a direction along a width direction of the printing medium is a longitudinal direction of the ultraviolet irradiation part, the ultraviolet irradiation part being configured to irradiate, with ultraviolet light from an irradiation surface thereof, the printing medium on which the ink is discharged, a protrusion fixed to the ultraviolet irradiation part and protruding further toward the supporting part side than the irradiation surface does, a frame configured to support the ultraviolet irradiation part, and an attaching position adjustment part for attachment position adjustment of the ultraviolet irradiation part with respect to the frame, the attaching position adjustment part including an attaching part fixed to the ultraviolet irradiation part and attachable to the frame with an attaching position thereof adjusted and a guide part attachable to the frame and configured to guide the adjustment of the attaching position of the attaching part with respect to the frame. The guide part includes a first butted part and a second butted part disposed at a position opposite the first butted part, the second butted part being provided further toward the supporting part side than the first butted part is, and the attaching part includes a butting part located between the first butted part and the second butted part in an opposing direction in which the first butted part and the second butted part are opposite each other, the butting part having a width smaller than a spacing between the first butted part and the second butted part, and a distance between the irradiation surface and the supporting part is a sum of a difference between the width of the butting part and the spacing in the opposing direction and a protruding length of the protrusion from the irradiation surface.

According to the present aspect, the butting part is disposed between the first butted part and the second butted part, and the distance between the irradiation surface and the supporting part is the sum of the difference between the spacing between the first butted part and the butted part and the width of the butting part, and the protruding length of the protrusion from the irradiation surface. That is, the spacing, which is the movement range of the butting part in the opposing direction, corresponds to the distance between the protrusion and the supporting part, and the protrusion is fixed to the ultraviolet irradiation part, and thus, the ultraviolet irradiation part can be easily and accurately positioned by adjusting the spacing to a desired length.

In the printing apparatus according to a second aspect of the present disclosure in the first aspect, the attaching position adjustment part is provided on both sides of a center in the longitudinal direction of the ultraviolet irradiation part.

According to the present aspect, since the ultraviolet irradiation part can be positioned on both sides in the longitudinal direction of the ultraviolet irradiation part, skewed positioning of the ultraviolet irradiation part with respect to the supporting part in the longitudinal direction of the ultraviolet irradiation part can be suppressed, and particularly the ultraviolet irradiation part can be highly accurately positioned.

In the printing apparatus according to a third aspect of the present disclosure in the first or second aspect, the guide part includes butted part pairs each including the first butted part and the second butted part at a plurality of locations in a short direction of the ultraviolet irradiation part, and the attaching part includes a plurality of the butting parts correspondingly to the butted part pairs at the plurality of locations.

According to the present aspect, since the ultraviolet irradiation part can be positioned at a plurality of locations in the short direction of the ultraviolet irradiation part, skewed positioning of the ultraviolet irradiation part with respect to the supporting part in the short direction of the ultraviolet irradiation part can be suppressed, and particularly the ultraviolet irradiation part can be highly accurately positioned.

In the printing apparatus according to a fourth aspect of the present disclosure in any one of the first to third aspects, the protrusion is formed along the longitudinal direction of the ultraviolet irradiation part at a position between an irradiation opening of the ultraviolet irradiation part and the head in a short direction of the ultraviolet irradiation part.

According to the present aspect, since the protrusion is formed entirely along the longitudinal direction of the ultraviolet irradiation part at a position between the irradiation opening of the ultraviolet irradiation part and the head in the short direction of the ultraviolet irradiation part, the protrusion functions as a blocking member, and it is thus possible to reduce the ultraviolet light that reaches the head from the ultraviolet irradiation part.

A printing apparatus according to a fifth aspect of the present disclosure includes a supporting part for a printing medium, a head provided at a position opposite the supporting part and configured to discharge ultraviolet-curable ink to the printing medium, an ultraviolet irradiation part including a butting part and disposed at a position opposite the supporting part such that a direction along a width direction of the printing medium is a longitudinal direction of the ultraviolet irradiation part, the ultraviolet irradiation part being configured to irradiate, with ultraviolet light from an irradiation surface thereof, the printing medium on which the ink is discharged, a protrusion fixed to the ultraviolet irradiation part and protruding further toward the supporting part side than the irradiation surface does, a frame configured to support the ultraviolet irradiation part, and an attaching part fixed to the butting part of the ultraviolet irradiation part and attachable to the frame with an attaching position thereof adjusted, and a guide part attachable to the frame and configured to guide the adjustment of the attaching position of the attaching part with respect to the frame. The guide part includes a first butted part and a second butted part disposed at a position opposite the first butted part, the second butted part being provided further toward the supporting part side than the first butted part is, and the butting part is located between the first butted part and the second butted part in an opposing direction in which the first butted part and the second butted part are opposite each other, and has a width smaller than a spacing between the first butted part and the second butted part, and a distance between the irradiation surface and the supporting part is a sum of a difference between the width of the butting part and the spacing in the opposing direction and a protruding length of the protrusion from the irradiation surface.

According to the present aspect, the butting part is disposed between the first butted part and the second butted part, and the distance between the irradiation surface and the supporting part is the sum of the difference between the spacing between the first butted part and the butted part and the width of the butting part, and the protruding length of the protrusion from the irradiation surface. That is, the spacing, which is the movement range of the butting part in the opposing direction, corresponds to the distance between the protrusion and the supporting part, and the protrusion is fixed to the ultraviolet irradiation part, and thus, the ultraviolet irradiation part can be easily and accurately positioned by adjusting the spacing to a desired length.

In the printing apparatus according to a sixth aspect of the present disclosure in the fifth aspect, the butting part is provided on both sides of a center in the longitudinal direction of the ultraviolet irradiation part, and the guide part includes a butted part pair, including the first butted part and the second butted part, and provided on both sides of the ultraviolet irradiation part, with respect to a center in the longitudinal direction of the ultraviolet irradiation part.

According to the present aspect, since the ultraviolet irradiation part can be positioned on both sides in the longitudinal direction of the ultraviolet irradiation part, skewed positioning of the ultraviolet irradiation part with respect to the supporting part in the longitudinal direction of the ultraviolet irradiation part can be suppressed, and particularly the ultraviolet irradiation part can be highly accurately positioned.

In the printing apparatus according to a seventh aspect of the present disclosure in the fifth or sixth aspect, the guide part includes butted part pairs each including the first butted part and the second butted part at a plurality of locations in a short direction of the ultraviolet irradiation part, and the ultraviolet irradiation part includes a plurality of the butting parts correspondingly to the butted part pairs at the plurality of locations.

According to the present aspect, since the ultraviolet irradiation part can be positioned at a plurality of locations in the short direction of the ultraviolet irradiation part, skewed positioning of the ultraviolet irradiation part with respect to the supporting part in the short direction of the ultraviolet irradiation part can be suppressed, and particularly the ultraviolet irradiation part can be highly accurately positioned.

In the printing apparatus according to an eighth aspect of the present disclosure in any one of the fifth to seventh aspects, the protrusion is formed along the longitudinal direction of the ultraviolet irradiation part at a position between an irradiation opening of the ultraviolet irradiation part and the head in a short direction of the ultraviolet irradiation part.

According to the present aspect, since the protrusion is formed entirely along the longitudinal direction of the ultraviolet irradiation part at a position between the irradiation opening of the ultraviolet irradiation part and the head in the short direction of the ultraviolet irradiation part, the protrusion functions as a blocking member, and it is thus possible to reduce the ultraviolet light that reaches the head from the ultraviolet irradiation part.

A printing apparatus according to a ninth aspect of the present disclosure includes a supporting part for a printing medium, a head provided at a position opposite the supporting part and configured to discharge ultraviolet-curable ink to the printing medium, an ultraviolet irradiation part disposed at a position opposite the supporting part such that a direction along a width direction of the printing medium is a longitudinal direction of the ultraviolet irradiation part, the ultraviolet irradiation part including a first side contacting part on a first side in the longitudinal direction and configured to irradiate, with ultraviolet light from an irradiation surface thereof, the printing medium on which the ink is discharged, a protrusion fixed to the ultraviolet irradiation part and protruding further toward the supporting part side than the irradiation surface does, a frame configured to support the ultraviolet irradiation part, and a first side attaching part provided on the first side in the longitudinal direction of the ultraviolet irradiation part and fixed to the first side butting part of the ultraviolet irradiation part, and moreover attachable to the frame with an attaching position thereof adjusted, a first side guide part provided on the first side in the longitudinal direction of the ultraviolet irradiation part and attachable to the frame and moreover configured to guide the adjustment of the attaching position of the first side attaching part with respect to the frame, a second side attaching part provided on a second side in the longitudinal direction of the ultraviolet irradiation part and fixed to the ultraviolet irradiation part and moreover attachable to the frame with an attaching position thereof adjusted, and a second side guide part provided on the second side in the longitudinal direction of the ultraviolet irradiation part and attachable to the frame and moreover configured to guide the adjustment of the attaching position of the second side attaching part with respect to the frame. Each of the first side guide part and the second side guide part includes a butted part pair including a first butted part and a second butted part disposed at a position opposite the first butted part, the second butted part being provided further toward the supporting part side than the first butted part, on the first side in the longitudinal direction of the ultraviolet irradiation part, the first side butting part is located between the first butted part and the second butted part in an opposing direction in which the first butted part and the second butted part are opposite each other, and has a width smaller than a first side spacing that is a spacing between the first butted part and the second butted part, on the second side in the longitudinal direction of the ultraviolet irradiation part, the second side attaching part includes a second side butting part that is located between the first butted part and the second butted part in an opposing direction in which the first butted part and the second butted part are opposite each other, the second side butting part having a width smaller than a second side spacing that is a spacing between the first butted part and the second butted part, the first side spacing and the second side spacing are equal to each other, a difference between the first side spacing and the width of the first side butting part and a difference between the second side spacing and the width of the second side butting part are equal to each other in the opposing direction, a distance between the irradiation surface and the supporting part is a sum of the difference between the first side spacing and the width of the first side butting part in the opposing direction and a protruding length of the protrusion from the irradiation surface, and is a sum of a difference between the second side spacing and the width of the second side butting part and the protruding length of the protrusion from the irradiation surface.

According to the present aspect, the butting part is disposed between the first butted part and the second butted part, and the distance between the irradiation surface and the supporting part is the sum of the difference between the spacing between the first butted part and the butted part and the width of the butting part, and the protruding length of the protrusion from the irradiation surface. That is, the spacing, which is the movement range of the butting part in the opposing direction, corresponds to the distance between the protrusion and the supporting part, and the protrusion is fixed to the ultraviolet irradiation part, and thus, the ultraviolet irradiation part can be easily and accurately positioned by adjusting the spacing to a desired length. In addition, since the ultraviolet irradiation part can be positioned on both sides in the longitudinal direction of the ultraviolet irradiation part, skewed positioning of the ultraviolet irradiation part with respect to the supporting part in the longitudinal direction of the ultraviolet irradiation part can be suppressed, and particularly the ultraviolet irradiation part can be highly accurately positioned.

In the printing apparatus according to a tenth aspect of the present disclosure in the ninth aspect, the protrusion is formed along the longitudinal direction of the ultraviolet irradiation part at a position between an irradiation opening of the ultraviolet irradiation part and the head in a short direction of the ultraviolet irradiation part.

According to the present aspect, since the protrusion is formed entirely along the longitudinal direction of the ultraviolet irradiation part at a position between the irradiation opening of the ultraviolet irradiation part and the head in the short direction of the ultraviolet irradiation part, the protrusion functions as a blocking member, and it is thus possible to reduce the ultraviolet light that reaches the head from the ultraviolet irradiation part.

A positioning method according to an eleventh aspect of the present disclosure is a method for positioning an ultraviolet irradiation part of the printing apparatus according to any one of the first to fourth aspects, the printing apparatus including a first fixing member configured to fix the attaching part to the frame such that an attaching position thereof is adjustable, and a second fixing member configured to fix the guide part to the frame such that an attaching position thereof is adjustable, the method including a first step for fixing the attaching part to the frame with the first fixing member in a state where the protrusion is in contact with the supporting part, a second step for, after the first step, fixing the guide part to the frame with the second fixing member in a state where the butting part is in contact with the second butted part, and a third step for, after the second step, temporarily releasing the fixing to the frame with the first fixing member and bringing the butting part into contact with the first butted part, then, fixing the attaching part to the frame with the first fixing member.

According to the present aspect, the distance between the irradiation surface and the supporting part can be simply set to the sum of the difference between the spacing between the first butted part and the butted part and the width of the butting part, and the protruding length of the protrusion from the irradiation surface in the opposite direction, and the ultraviolet irradiation part can be simply and highly accurately positioned.

A positioning method according to a twelfth aspect of the present disclosure is a method for positioning an ultraviolet irradiation part of the printing apparatus according to any one of the fifth to eighth aspects, the printing apparatus including a first fixing member configured to fix the attaching part to the frame such that an attaching position thereof is adjustable, and a second fixing member configured to fix the guide part to the frame such that an attaching position thereof is adjustable, the method including a first step for fixing the attaching part to the frame with the first fixing member in a state where the protrusion is in contact with the supporting part, a second step for, after the first step, fixing the guide part to the frame with the second fixing member in a state where the butting part is in contact with the second butted part, and a third step for, after the second step, the fixing to the frame with the first fixing member and bringing the butting part into contact with the first butted part, then, fixing the attaching part to the frame with the first fixing member.

According to the present aspect, the distance between the irradiation surface and the supporting part can be simply set to the sum of the difference between the spacing between the first butted part and the butted part and the width of the butting part, and the protruding length of the protrusion from the irradiation surface in the opposite direction, and the ultraviolet irradiation part can be simply and highly accurately positioned.

Embodiments of the present disclosure are described below with reference to the accompanying drawings.

Example 1

First, an overview of a printing apparatus 1 according to Example 1 of the present disclosure is described with reference to FIG. 1.

The printing apparatus 1 of this example is a printing apparatus that performs printing of an image on a printing medium M such as paper, cloth, film, or the like, and is communicably coupled to a computer (not illustrated) that is an external device. While the printing apparatus 1 of this example is configured to perform printing on the printing medium M wound in a roll shape as illustrated in FIG. 1, the printing apparatus 1 may be configured to perform printing on the printing medium M of a single sheet type such as cut paper.

As illustrated in FIG. 1, the printing apparatus 1 of this example includes a feeding unit 2 that can feed the printing medium M by rotating in a rotation direction C with the printing medium M of a roll form set thereto. The feeding unit 2 feeds the printing medium M to a first transport roller pair 9. Then, the medium is conveyed by the first transport roller pair 9 in a transport direction A.

The printing medium M transported by the first transport roller pair 9 reaches a transport drum 3 serving as a supporting part of the printing medium M through a relay roller 10, and is transported in the state where the printing medium M is adhered to the transport drum 3 rotating in the rotation direction C. At positions facing the transport drum 3, four head units 21 are formed. Each head unit 21 includes a head 5 that discharges ultraviolet-curable ink, and a temporary irradiation unit 7 that includes an ultraviolet irradiation part 27 that irradiates, from an LED, ultraviolet light for temporary cure illustrated in FIG. 4 and the like. Specifically, a head unit 21*a* including a head 5*a* corresponding to cyan ink and a temporary irradiation unit 7*a*, a head unit 21*b* including a head 5*b* corresponding to magenta ink and a temporary irradiation unit 7*b*, a head unit 21*c* including a head 5*c* corresponding to yellow ink and a temporary irradiation unit 7*c*, and a head unit 21*d* including a head 5*d* corresponding to black ink and a temporary irradiation unit 7*d* are formed. In addition, a main curing unit 8 serving as an ultraviolet irradiation part that mainly cures the ultraviolet-curable ink is formed at a position downstream of the four head units 21 in the transport direction A so as to face the transport drum 3. Note that the head unit 21*a*, the head unit 21*b*, the head unit 21*c*, and the head unit 21*d* have the same shape.

An image is formed by the four head units 21 on the printing medium M transported in the state of being adhered to the transport drum 3. Then, the image formed by the four head units 21 on the printing medium M is fixed to the printing medium M when the ink forming the image is mainly cured by the main curing unit 8.

In addition, a tension roller 11 is provided at a position downstream of the main curing unit 8 in the transport direction A, and the printing medium M is conveyed from the transport drum 3 to a second transport roller pair 12 through the tension roller 11. Then, the printing medium M transported by the second transport roller pair 12 is wound in a roll shape while being rotated around a winding unit 4 in the rotation direction C.

Here, each head 5 of the printing apparatus 1 of this example is a line head in which a nozzle is formed in a line shape along a width direction B of the printing medium M. In other words, the printing apparatus 1 of this example is a so-called line printer that continuously performs printing while continuously transporting the printing medium M. Note that it is also possible to adopt a printer including a head that discharges ink while moving back and forth in a direction intersecting the transport direction A.

Next, a detailed configuration of the temporary irradiation unit 7, which is a main part of the printing apparatus 1 of this example, is described in detail with reference to FIGS. 2 to 6. While FIGS. 2 to 6 illustrate one side in the width direction B of the temporary irradiation unit 7 of the present example, the same configuration is provided also on the other side in the width direction B.

Figure 2:
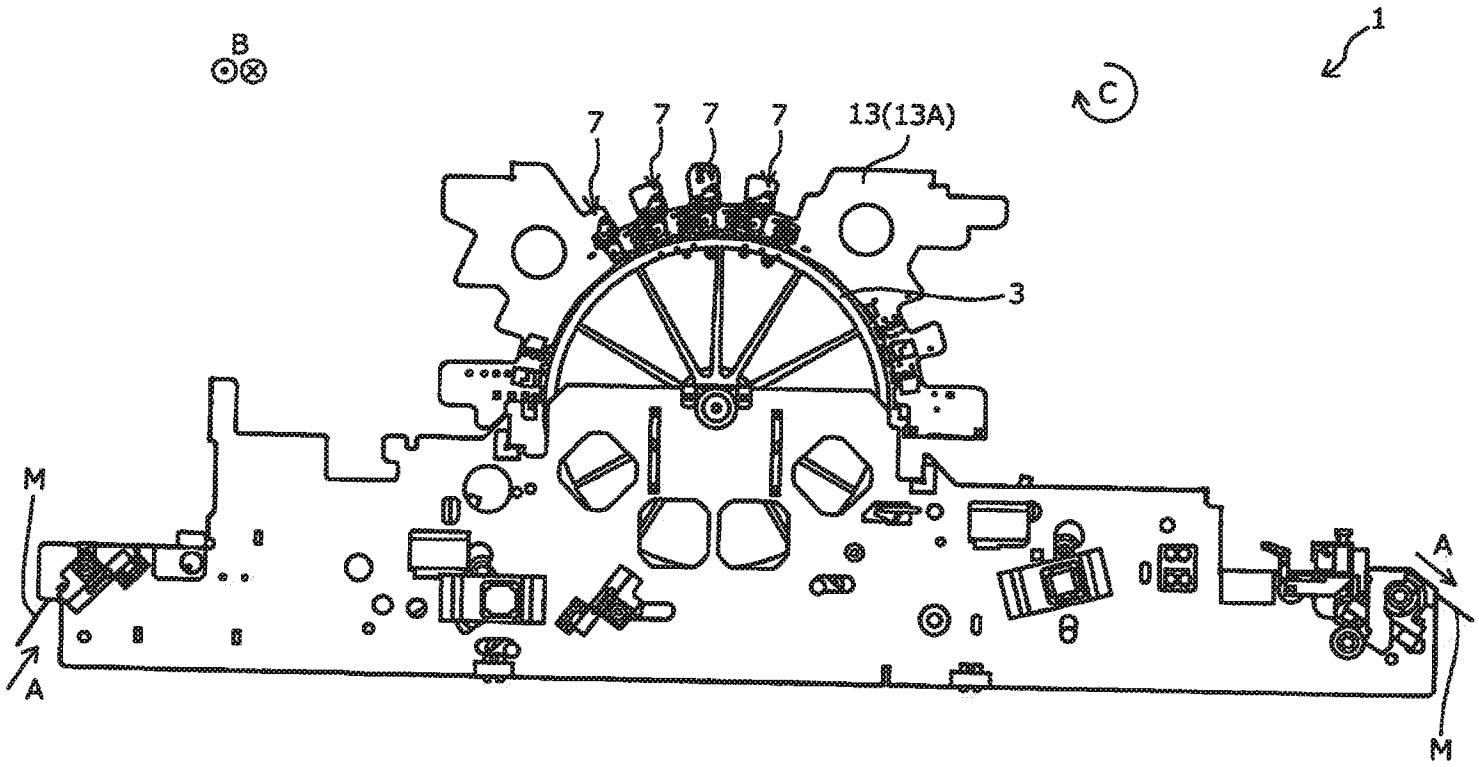
FIG. 2 is a side view of the printing apparatus according to Example 1 of the present disclosure.
Figure 3:
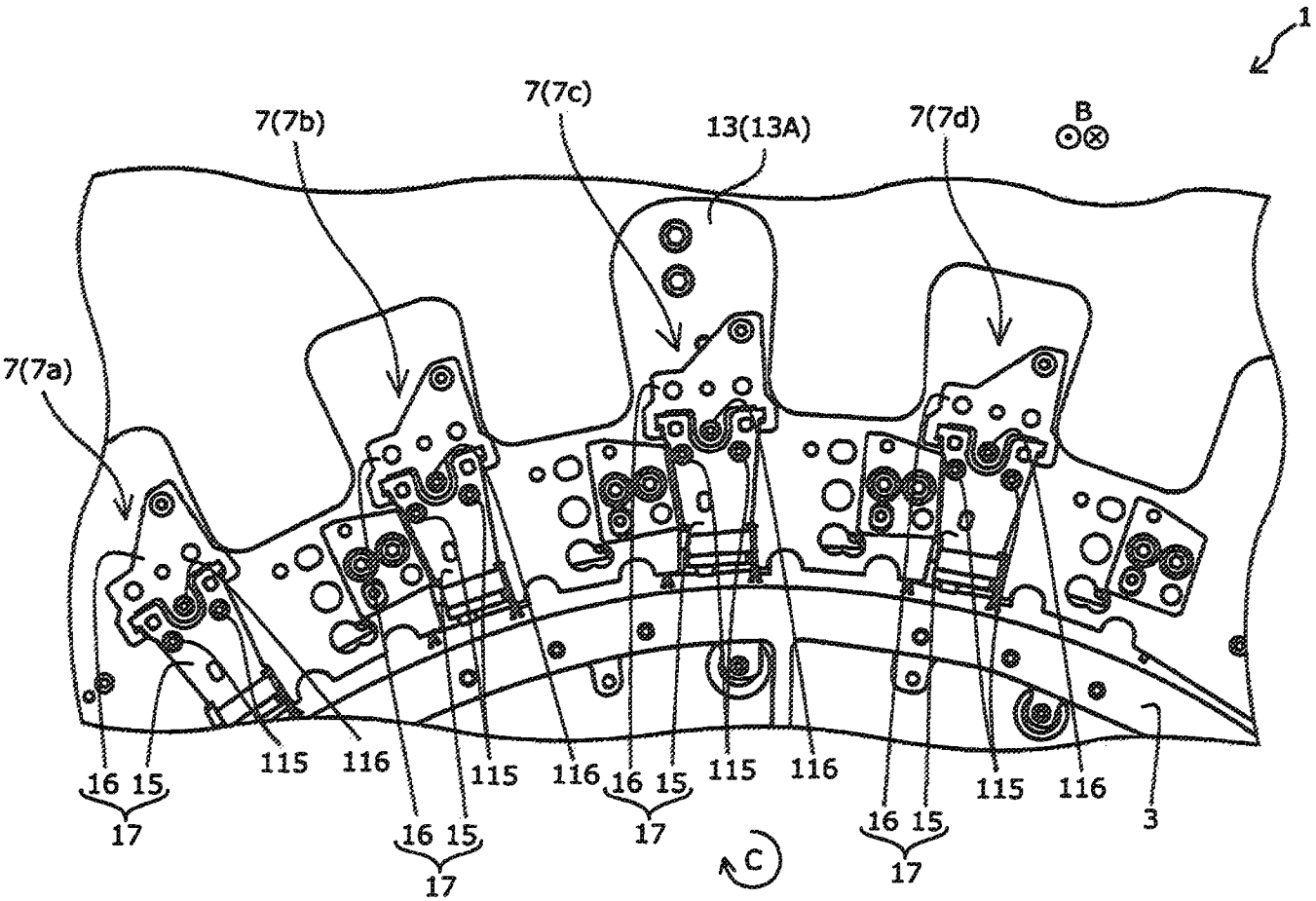
FIG. 3 is a side view illustrating a main part of the printing apparatus according to Example 1 of the present disclosure.
Figure 4:
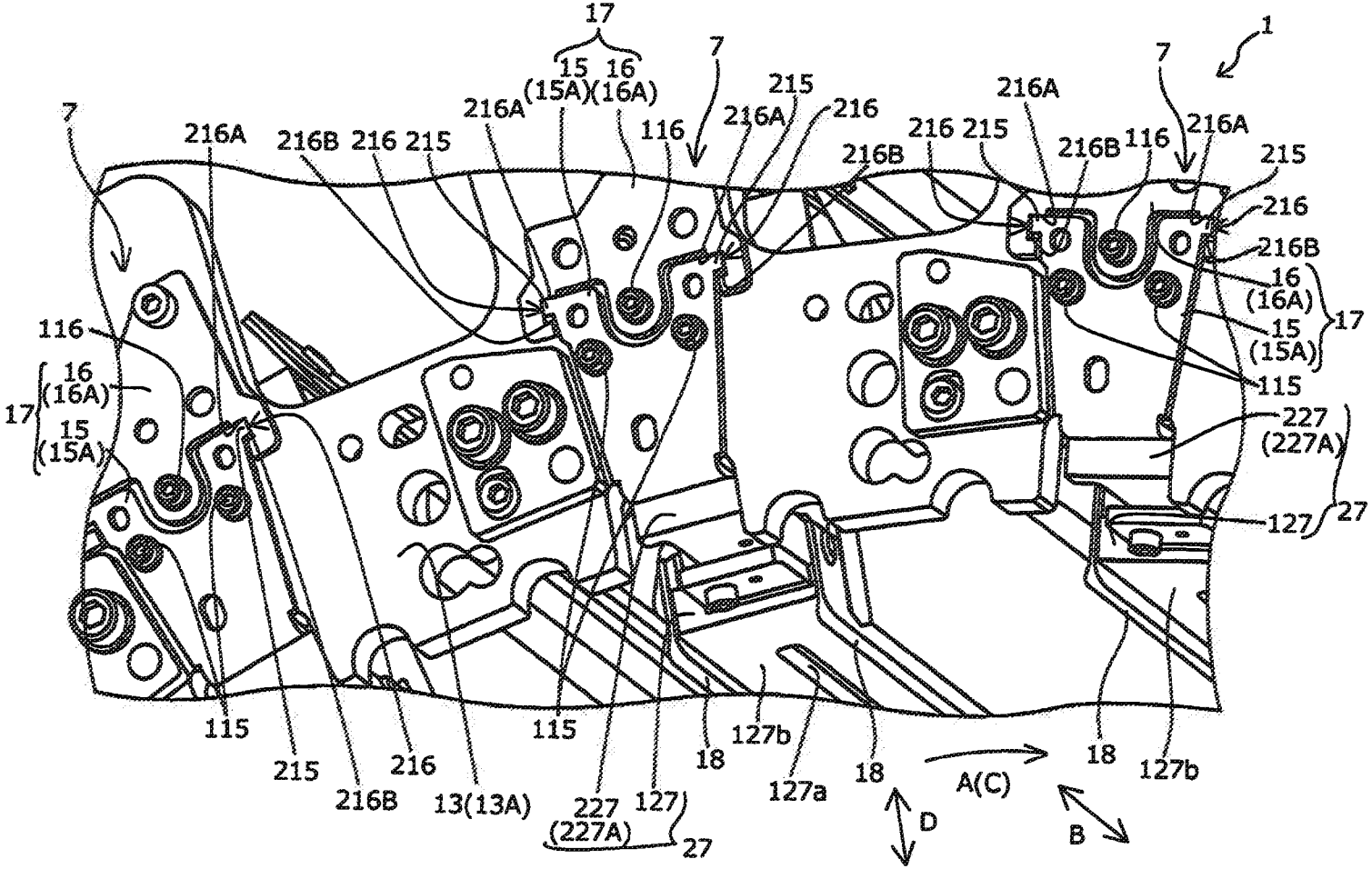
FIG. 4 is a perspective view illustrating a main part of the printing apparatus according to Example 1 of the present disclosure.

As illustrated in FIGS. 2 to 4, the printing apparatus 1 of this example includes a frame 13 (frame 13A). Each of the four head units 21 is attached to the frame 13 with an attaching part 15 (attaching part 15A) therebetween. As illustrated in FIG. 4 and the like, the temporary irradiation unit 7 includes an ultraviolet irradiation part 27 including an irradiation port forming part 127 in which an ultraviolet light irradiation port 127*a* is formed in an irradiation surface 127*b* and a holding plate 227 (holding plate 227*a*) that holds the irradiation port forming part 127, an attaching part 15 that is fixed to the holding plate 227 of the ultraviolet irradiation part 27 and is attached to the frame 13 with a screw 115 such that that the attaching position can be adjusted with respect to the frame 13, and a guide part 16 (guide part 16A) that can guide the adjustment of the attaching position of the attaching part 15 with respect to the frame 13 and is attached with a screw 116 such that the attaching position can be adjusted with respect to the frame 13. Here, the attaching part 15 and the guide part 16 form an attaching position adjustment part 17 for the ultraviolet irradiation part 27 with respect to the frame 13. Note that the details of the attaching position adjustment of the ultraviolet irradiation part 27 with respect to the frame 13 are described later.

Here, the longitudinal direction of the ultraviolet irradiation part 27 is a direction along the width direction B, and the short direction of the ultraviolet irradiation part 27 is a direction along the transport direction A. In addition, as illustrated in FIGS. 2 to 4 and the like, a light shielding plate 18 protruding toward the transport drum 3 over the irradiation surface 127*b* is formed entirely along the longitudinal direction of ultraviolet irradiation part 27 at positions on both ends of the ultraviolet irradiation part 27 in the short direction. In other words, the light shielding plate 18 is formed at a position between the head 5 and the irradiation port 127*a* serving as an irradiation opening in the short direction of the ultraviolet irradiation part 27 such that the ultraviolet light emitted from the ultraviolet irradiation part 27 does not reach the head 5. Here, the light shielding plate 18 is screwed and fixed to the ultraviolet irradiation part 27, and is integrally formed with the ultraviolet irradiation part 27. While the light shielding plate 18 of the present example has a shape in which the end portion on the transport drum 3 side is divided, the shape of the light shielding plate 18 is not limited as long as the light shielding plate 18 protrudes toward the transport drum 3 over the irradiation surface 127*b*.

Next, a detailed configuration of the attaching position adjustment part 17 is described. As described above, the attaching position adjustment part 17 of the present example includes the attaching part 15 and the guide part 16. Here, the attaching part 15 of the present example is fixed to the ultraviolet irradiation part 27 with a screw (not illustrated), and is configured to be fixed such that the attaching position with respect to the frame 13 can be adjusted with the screw 115. In addition, the guide part 16 of the present example is configured such that the attaching position can be adjusted with respect to the frame 13 with the screw 116 and can guide the adjustment of the attaching position of the attaching part 15 with respect to the frame 13.

Figure 5:
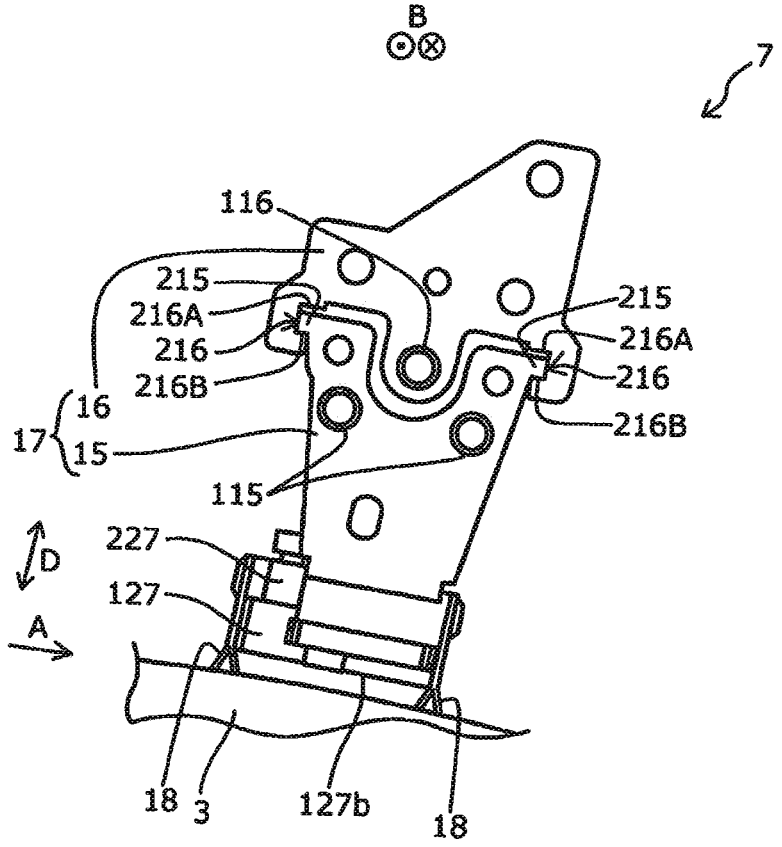
FIG. 5 is a diagram illustrating a state of a first step and a second step for describing a method of positioning an ultraviolet irradiation part that is performed using the printing apparatus according to Example 1 of the present disclosure.
Figure 6:
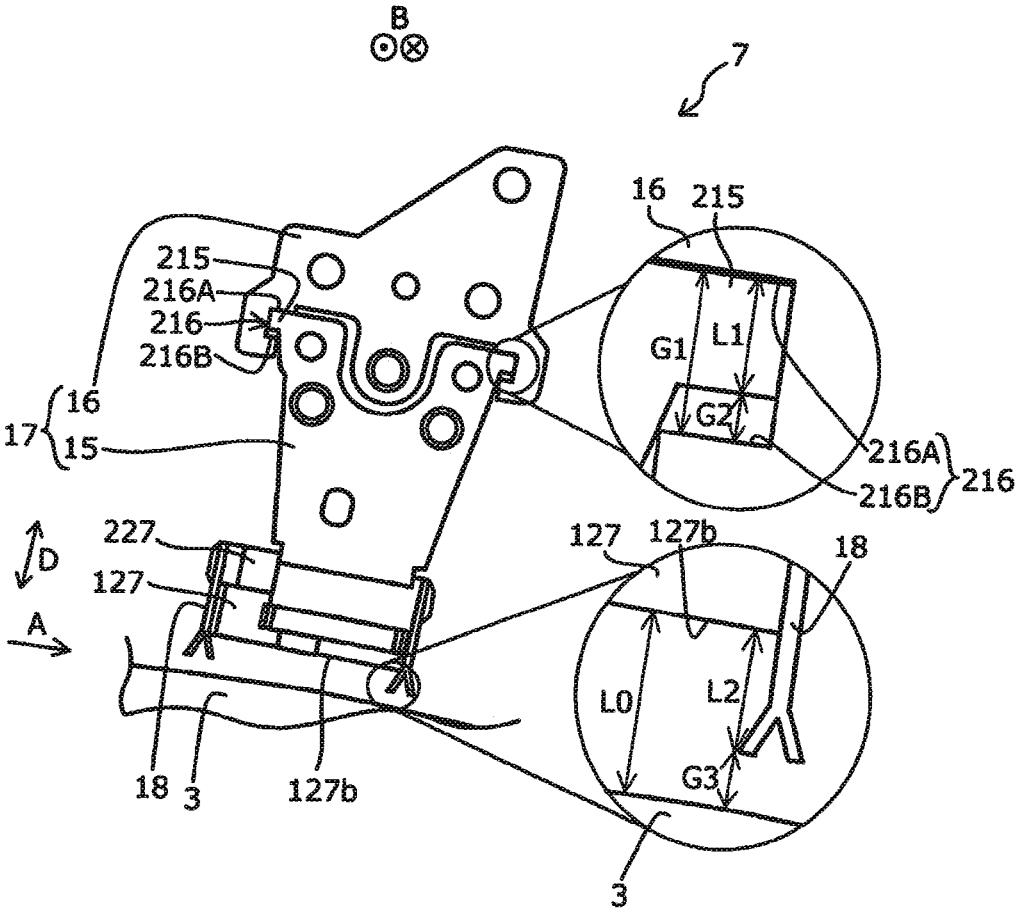
FIG. 6 is a diagram illustrating a state of a third step for describing a method of positioning the ultraviolet irradiation part that is performed using the printing apparatus according to Example 1 of the present disclosure.

As illustrated in FIGS. 4 to 6 and the like, the attaching part 15 includes a protruding butting part 215 that protrudes substantially along the transport direction A, and the guide part 16 includes a butted part pair 216 having a recessed shape to which the butting part 215 fits. In addition, the butted part pair 216 includes a first butted part 216A at a position where it can make contact with the butting part 215 on the side opposite to the transport drum 3, and a second butted part 216B at a position where it can make contact with the butting part 215 on the side nearer to the transport drum 3. Note that in an opposing direction D, in which the first butted part 216A and the second butted part 216B are opposite each other, a spacing G1 between the butted part pair 216 is greater than the length of the butting part 215, which is narrower in the opposing direction D.

Next, a procedure of attaching the temporary irradiation unit 7 to the frame 13 in the printing apparatus 1 of this example is described. First, as a first step, the attaching part 15 is fixed to the frame 13 with the screw 115 serving as a first fixing member in the state where the light shielding plate 18 serving as a protrusion is in contact with the transport drum 3. Next, as a second step, after the first step, the guide part 16 is fixed to the frame 13 with the screw 116 serving as a second fixing member in the state where the butting part 215 is in contact with the second butted part 216B. Note that FIG. 5 illustrates a state of the temporary irradiation unit 7 in the first step and the second step. Then, as a third step, after the second step, the fixation to the frame 13 with the screw 115 is temporarily released, and the butting part 215 is brought into contact with the first butted part 216A, and then, the attaching part 15 is fixed to the frame 13 with the screw 115. Note that FIG. 6 illustrates a state of the temporary irradiation unit 7 in the third step.

As illustrated in FIG. 6, when the temporary irradiation unit 7 is attached to the frame 13 through the above-described procedure, a difference G2 between a width L1 of the butting part and the spacing G1 of the butted part pair 216 in the opposing direction D, and a spacing G3 between the light shielding plate 18 and the transport drum 3 are equal to each other. In other words, a distance L0 between the irradiation surface 127*b* and the transport drum 3 is a sum of the difference G2 between the width L1 of the butting part and the spacing G1 of the butted part pair 216 in the opposing direction D, and a protruding length L2 of the light shielding plate 18 from the irradiation surface 127*b*.

The printing apparatus 1 of this example includes the transport drum 3 for the printing medium M, the head 5 provided at a position opposite the transport drum 3, the head 5 being configured to discharge ultraviolet-curable ink to the printing medium M, an ultraviolet irradiation part 27 disposed at a position opposite the transport drum 3 such that a longitudinal direction of the ultraviolet irradiation part 27 is set as a direction along the width direction B of the printing medium M, the ultraviolet irradiation part 27 being configured to irradiate, with ultraviolet light from the irradiation surface 127*b*, the printing medium M on which the ink is discharged, the light shielding plate 18 fixed to the ultraviolet irradiation part 27 and protruding over the irradiation surface 127*b* toward the transport drum 3, the frame 13 configured to support the ultraviolet irradiation part 27, and the attaching position adjustment part 17 for the ultraviolet irradiation part 27 with respect to the frame 13, the attaching position adjustment part 17 including the attaching part 15 fixed to the ultraviolet irradiation part 27 and the guide part 16 attachable to the frame 13, the attaching part 15 being attachable to the frame 13 with an attaching position thereof adjusted, the guide part 16 being configured to guide the adjustment of the attaching position of the attaching part 15 with respect to the frame 13. The guide part 16 includes the first butted part 216A and the second butted part 216B disposed at a position opposite the first butted part 216A, the second butted part 216B being nearer to the transport drum 3 than the first butted part 216A. The attaching part 15 includes a butting part 215 located between the first butted part 216A and the second butted part 216B in the opposing direction D in which the first butted part 216A and the second butted part 216B are opposite each other, the butting part 215 having a width smaller than the spacing G1 between the first butted part 216A and the second butted part 216B. The distance L0 between the irradiation surface 127*b* and the transport drum 3 is a sum of the difference G2 between the width L1 of the butting part 215 and the spacing G1 in the opposing direction D and the protruding length L2 of the light shielding plate 18 from the irradiation surface 127*b*.

Thus, in the printing apparatus 1 of this example, the butting part 215 is disposed in the spacing G1 between the first butted part 216A and the second butted part 216B, and the distance L0 between the irradiation surface 127*b* and the transport drum 3 is the sum of the difference G2 between the spacing G1 and the width L1 of the butting part 215, and the protruding length L2 of the light shielding plate 18 from the irradiation surface 127*b*. In other words, in the printing apparatus 1 of this example, the spacing G1, which is the movement range of the butting part 215 in the opposing direction D, corresponds to the spacing G3 between the light shielding plate 18 and the transport drum 3 and the light shielding plate 18 is fixed to the ultraviolet irradiation part 27, and thus, the ultraviolet irradiation part 27 can be simply and highly accurately positioned by adjusting the spacing G1 to a desired length.

In addition, as described above, in the printing apparatus 1 of this example, the temporary irradiation unit 7 has the same configuration on the first side and the second side in the width direction B, and accordingly the attaching position adjustment part 17 is provided on both sides with respect to the center in the longitudinal direction of the ultraviolet irradiation part 27. Thus, since the ultraviolet irradiation part 27 can be positioned on both sides in the longitudinal direction of the ultraviolet irradiation part 27, skewed positioning of the ultraviolet irradiation part 27 with respect to the transport drum 3 in the longitudinal direction of the ultraviolet irradiation part 27 can be suppressed, and particularly the ultraviolet irradiation part 27 can be highly accurately positioned.

In addition, as illustrated in FIGS. 4 to 6, the printing apparatus 1 of this example includes the butting part 215 and the butted part pair 216 at two positions corresponding to one attaching position adjustment part 17. In other words, in the printing apparatus 1 of this example, the guide part 16 includes the butted part pair 216 including the first butted part 216A and the second butted part 216B at a plurality of locations in the short direction of the ultraviolet irradiation part 27, and the attaching part 15 includes a plurality of the butting parts 215 corresponding to the butted part pair 216 at the plurality of locations Thus, since the printing apparatus 1 of this example can position the ultraviolet irradiation part 27 at a plurality of locations in the short direction of the ultraviolet irradiation part 27, skewed positioning of the ultraviolet irradiation part 27 with respect to the transport drum 3 in the short direction of the ultraviolet irradiation part 27 can be suppressed, and particularly the ultraviolet irradiation part 27 can be highly accurately positioned.

In addition, as described above, in the printing apparatus 1 of this example, since the light shielding plate 18 is formed entirely along the longitudinal direction of the ultraviolet irradiation part 27 at a position between the irradiation port 127*a* and the head 5 in the short direction of the ultraviolet irradiation part 27, it is possible to effectively reduce the ultraviolet light that reaches the head 5 from the ultraviolet irradiation part 27.

As described above, by using the printing apparatus 1 of this example to perform the first step of fixing the attaching part 15 to the frame 13 with the screw 115 in a state where the light shielding plate 18 is in contact with the transport drum 3, the second step of fixing the guide part 16 to the frame 13 with the screw 116 in a state where the butting part 215 is in contact with the second butted part 216B after the first step, and a third step of fixing the attaching part 15 to the frame 13 with the screw 115 after temporarily releasing the fixing to the frame 13 with the screw 115 to bring the butting part 215 into contact with the first butted part 216A after the second step, the distance L0 between the irradiation surface 127*b* and the transport drum 3 can be easily set to the sum of the difference G2 between the width L1 of the butting part 215 and the spacing G1 between the first butted part 216A and the second butted part 216B in the opposing direction D, and a protruding length L2 of the light shielding plate 18 from the irradiation surface 127*b*, and the ultraviolet irradiation part 27 can be simply and highly accurately positioned.

Example 2

Next, the printing apparatus 1 according to Example 2 is described with reference to FIG. 7 to FIG. 11. Here, the printing apparatus 1 of this example has the same configuration as the printing apparatus 1 according to Example 1 except for the frame 13, the attaching part 15, the guide part 16, and the holding plate 227. Therefore, descriptions of the parts having common configurations, such as parts other than the frame 13, the attaching part 15, the guide part 16, and the holding plate 227, are omitted. Note that the constituent members common to those of Example 1 described above are denoted by the same reference numerals, and detailed descriptions thereof are omitted. While FIGS. 7 to 11 illustrate one side in the width direction B of the temporary irradiation unit 7 of the present example, the same configuration is provided also on the other side in the width direction B.

Figure 7:
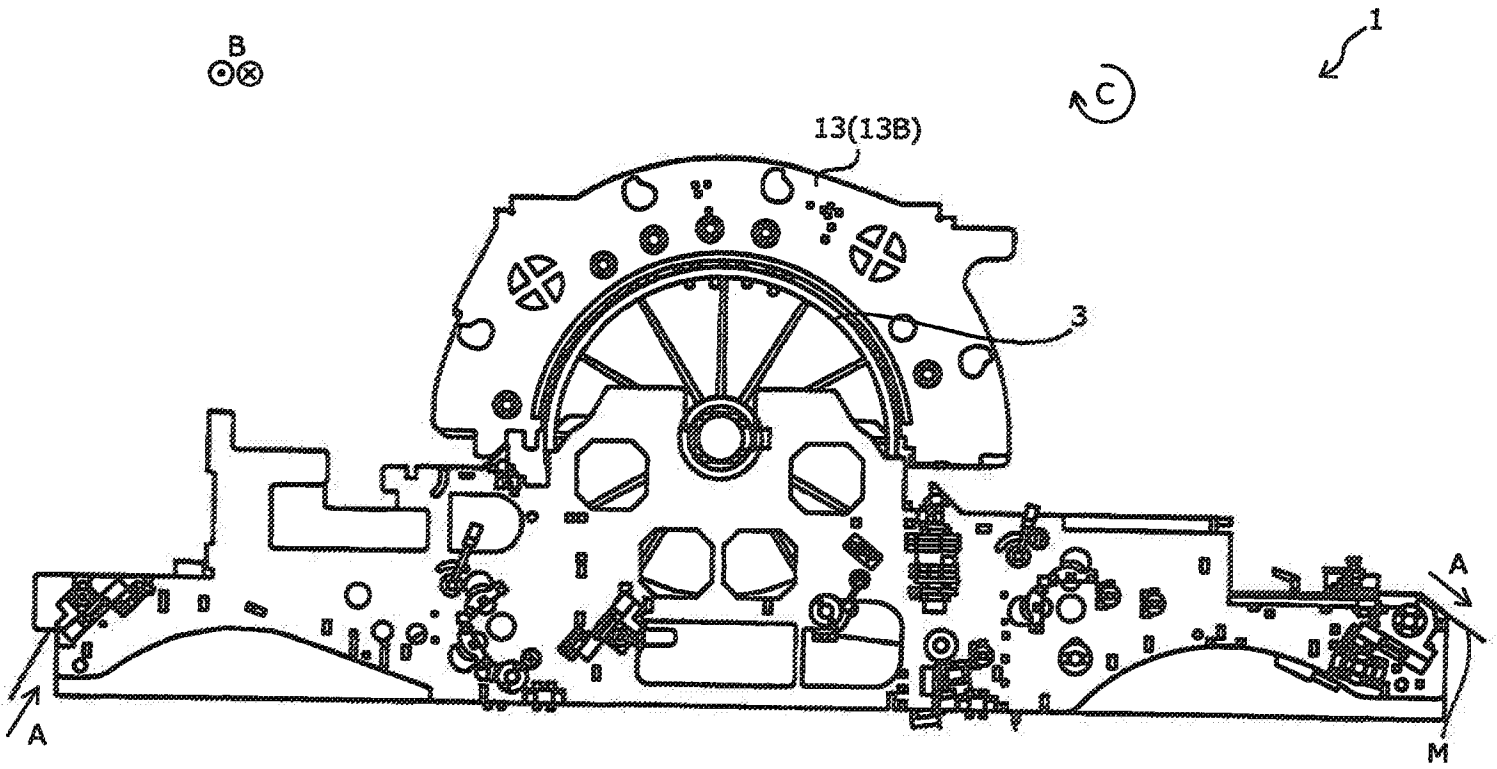
FIG. 7 is a side view of a printing apparatus according to Example 2 of the present disclosure.
Figure 8:
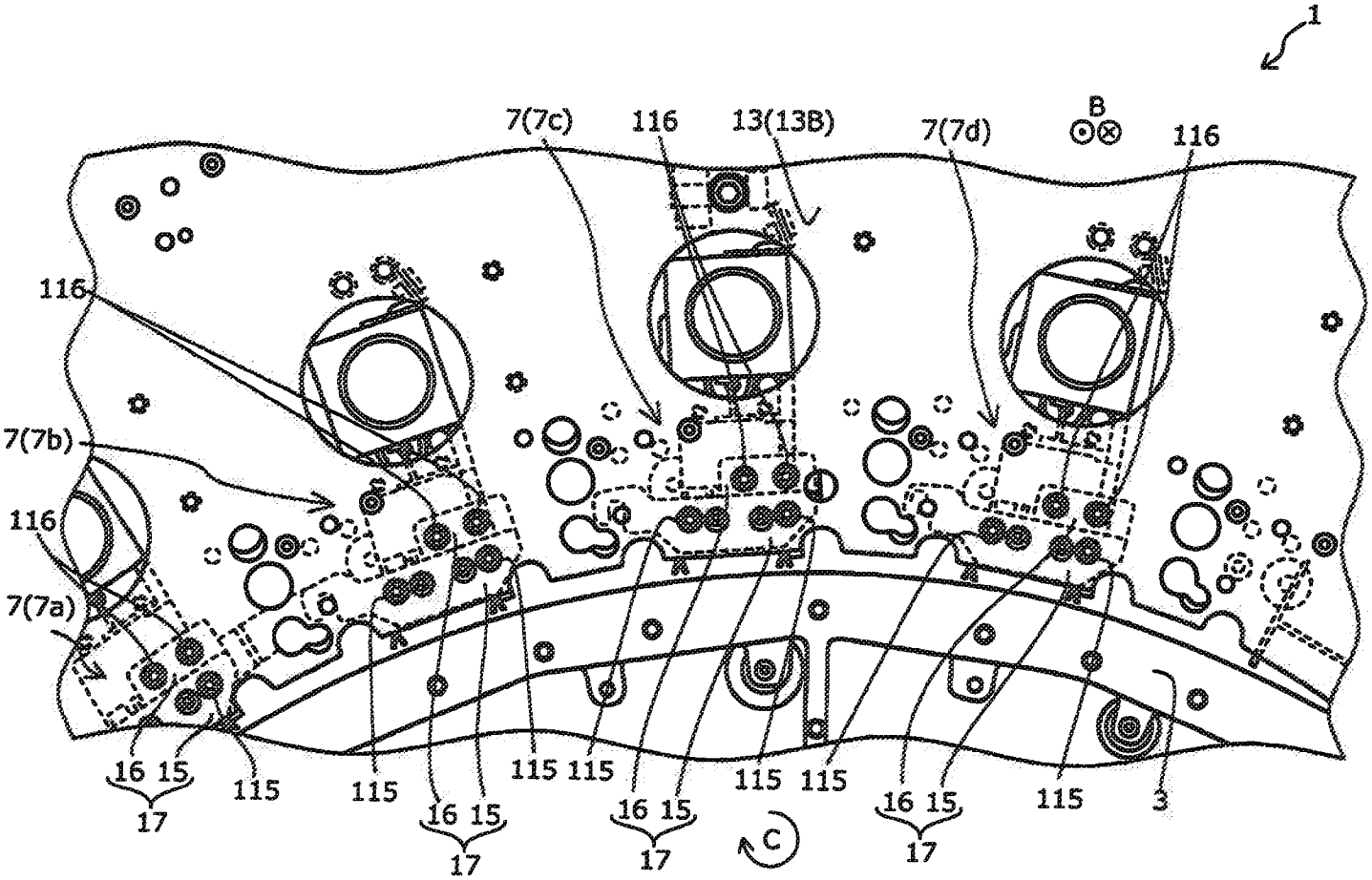
FIG. 8 is a side view of a main part of a printing apparatus according to Example 2 of the present disclosure.

As illustrated in FIGS. 7 and 8, the printing apparatus 1 of this example includes the frame 13 (frame 13B) having a shape different from the frame 13A in the printing apparatus 1 according to Example 1. Each of the four head units 21 is attached to the frame 13 with the attaching part 15 (attaching part 15B) therebetween. In addition, the guide part 16 (guide part 16B) that can guide the attaching position of the attaching part 15 with respect to the frame 13 and is attached such that the attaching position can be adjusted with respect to the frame 13 is provided. Note that the shapes of the attaching part 15B and the guide part 16B in the printing apparatus 1 of this example are different from the shapes of the attaching part 15A and the guide part 16A in the printing apparatus 1 according to Example 1.

Figure 9:
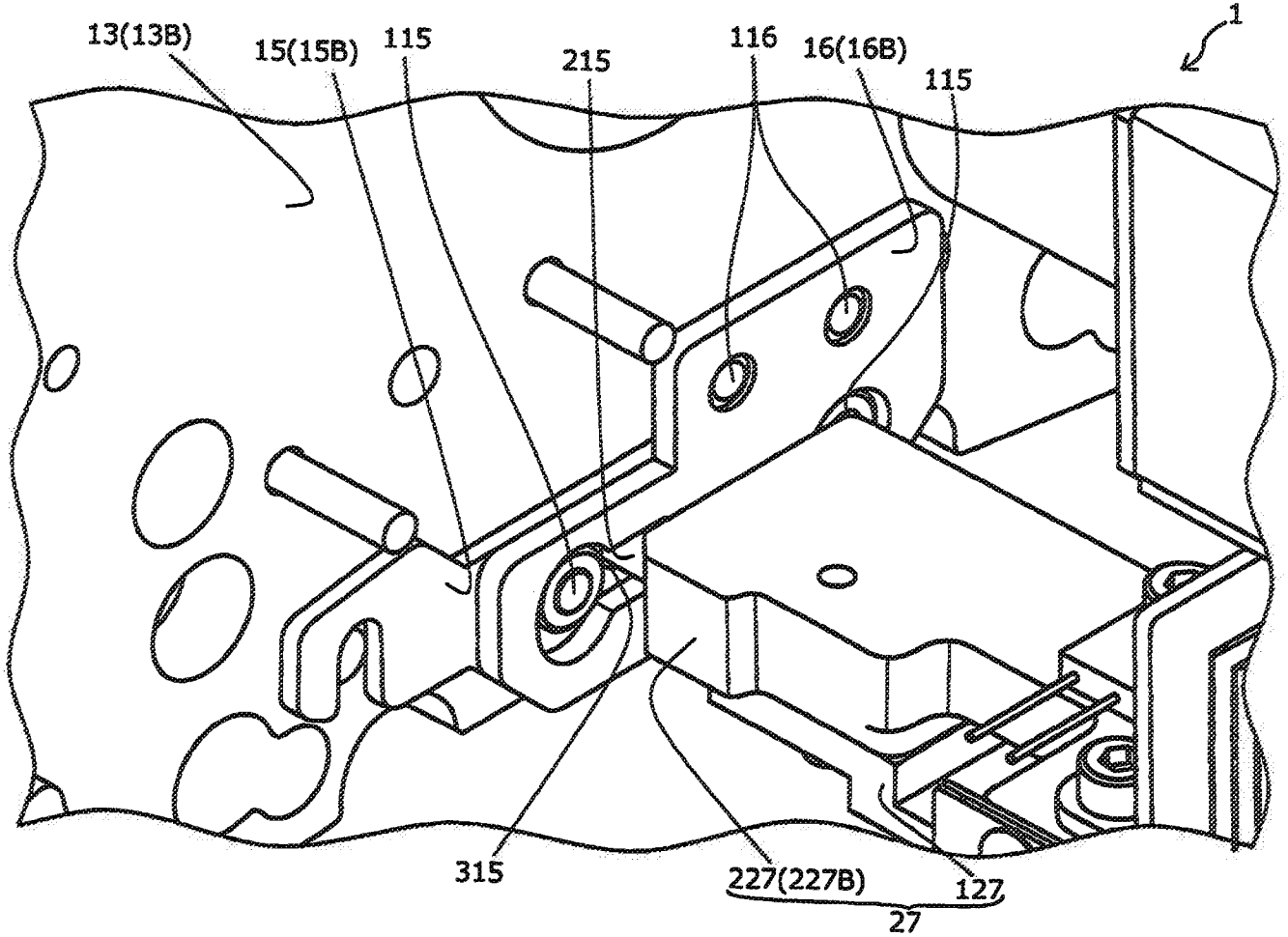
FIG. 9 is a perspective view illustrating a main part of the printing apparatus according to Example 2 of the present disclosure.
Figure 10:
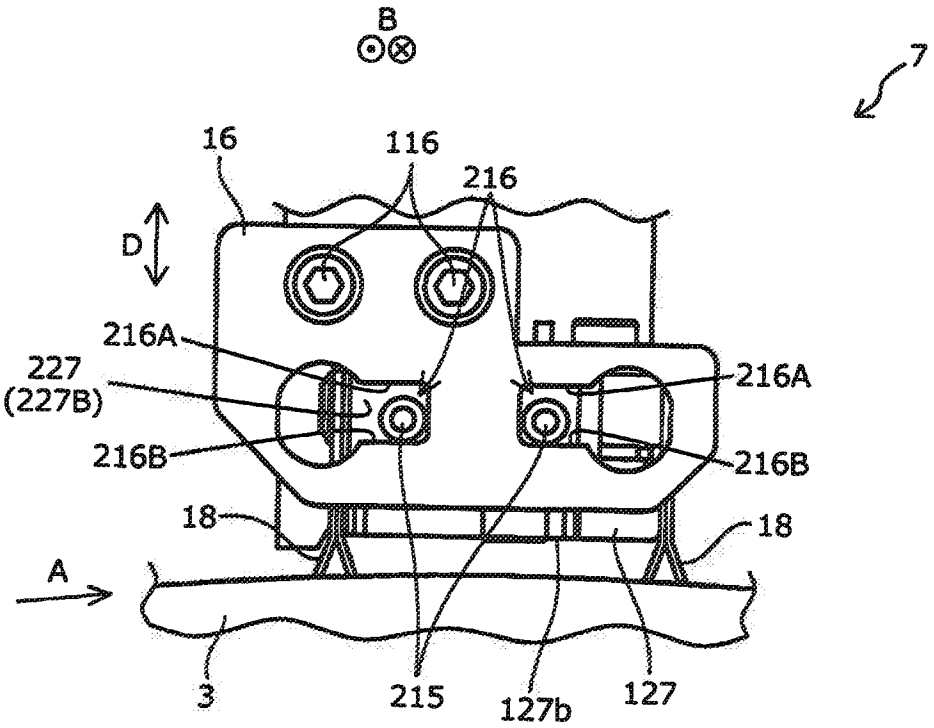
FIG. 10 is a diagram illustrating a state of a first step and a second step for describing a method of positioning an ultraviolet irradiation part that is performed using the printing apparatus according to Example 2 of the present disclosure.
Figure 11:
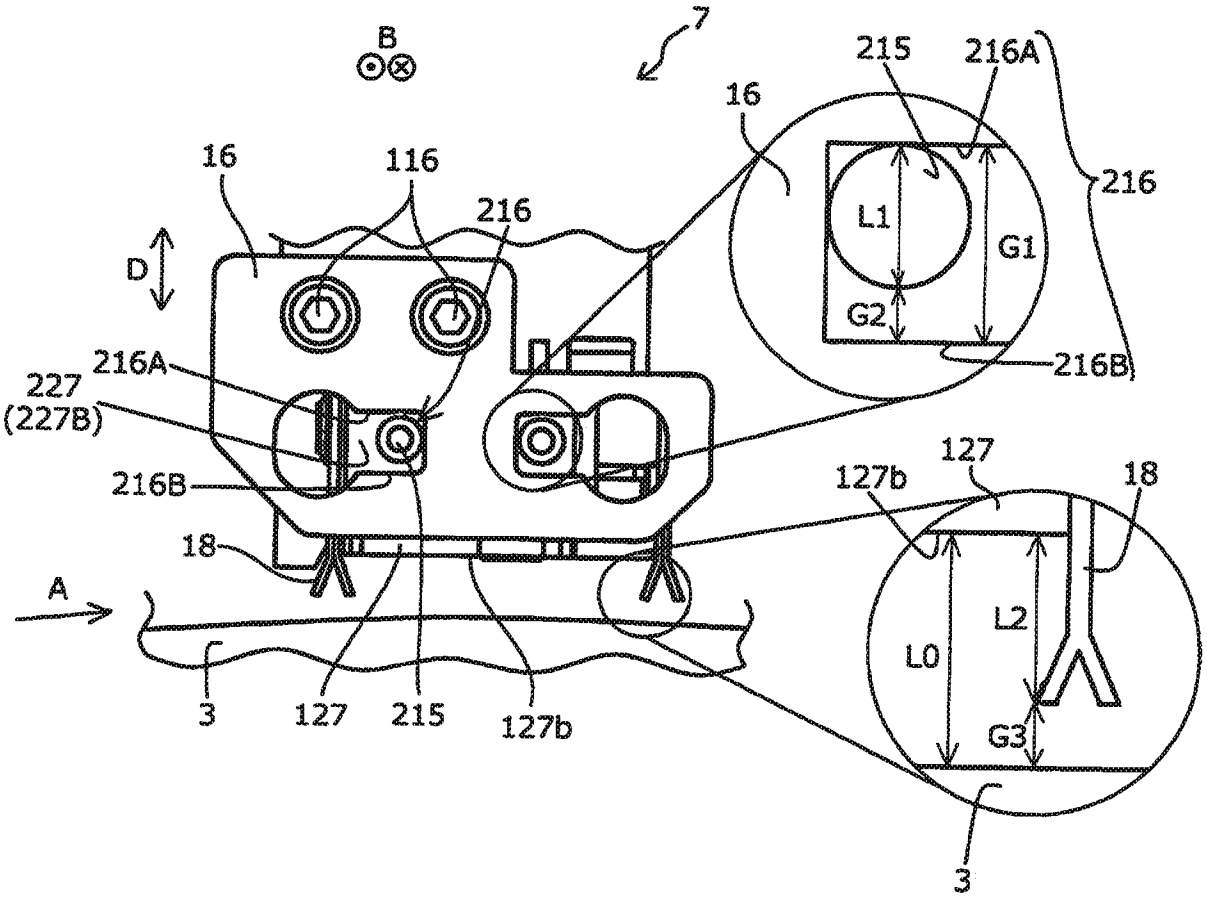
FIG. 11 is a diagram illustrating a state of a third step for describing a method of positioning the ultraviolet irradiation part that is performed using the printing apparatus according to Example 2 of the present disclosure.

In addition, as illustrated in FIG. 9 to FIG. 11, the holding plate 227 (holding plate 227B) of the printing apparatus 1 of this example includes the butting part 215 having a protruding shape on both ends in the width direction B. As illustrated in FIG. 9, the attaching part 15 of the present example is fixed to the frame 13 with the screw 115 in the state of being fixed to the ultraviolet irradiation part 27 with the butting part 215 fit in a hole part 315 with the guide part 16 therebetween. Here, as illustrated in FIGS. 10 and 11, the guide part 16 includes the butted part pair 216 having a hole shape through which the butting part 215 passes. The butted part pair 216 includes the first butted part 216A at a position where it can make contact with the butting part 215 on the side opposite to the transport drum 3, and the second butted part 216B at a position where it can make contact with the butting part 215 on the side nearer to the transport drum 3. Note that in an opposing direction D, in which the first butted part 216A and the second butted part 216B are opposite each other, a spacing G1 between the butted part pair 216 is greater than the length of the butting part 215, which is narrower in the opposing direction D.

Next, a procedure of attaching the temporary irradiation unit 7 to the frame 13 in the printing apparatus 1 of this example is described. First, as a first step, the attaching part 15 is fixed to the frame 13 with the screw 115 serving as a first fixing member in the state where the light shielding plate 18 serving as a protrusion is in contact with the transport drum 3. Next, as a second step, after the first step, the guide part 16 is fixed to the frame 13 with the screw 116 serving as a second fixing member in the state where the butting part 215 is in contact with the second butted part 216B. Note that FIG. 10 illustrates a state of the temporary irradiation unit 7 in the first step and the second step. Then, as a third step, after the second step, the fixation to the frame 13 with the screw 115 is temporarily released, and the butting part 215 is brought into contact with the first butted part 216A, and then, the attaching part 15 is fixed to the frame 13 with the screw 115. Note that FIG. 11 illustrates a state of the temporary irradiation unit 7 in the third step.

As illustrated in FIG. 11, when the temporary irradiation unit 7 is attached to the frame 13 through the above-described procedure, the difference G2 between the spacing G1 of the butted part pair 216 and the width L1 of the butting part in the opposing direction D, and the spacing G3 between the light shielding plate 18 and the transport drum 3 are equal to each other. In other words, the distance L0 between the irradiation surface 127*b* and the transport drum 3 is a sum of the difference G2 between the width L1 of the butting part 215 and the spacing G1 of the butted part pair 216 in the opposing direction D, and a protruding length L2 of the light shielding plate 18 from the irradiation surface 127*b*.

The printing apparatus 1 of this example includes the transport drum 3 for the printing medium M, the head 5 provided at a position opposite the transport drum 3, the head 5 being configured to discharge ultraviolet-curable ink to the printing medium M, the ultraviolet irradiation part 27 including a butting part 215 and disposed at a position opposite the transport drum 3 such that a longitudinal direction of the ultraviolet irradiation part 27 is set as a direction along the width direction B of the printing medium M, the ultraviolet irradiation part 27 being configured to irradiate, with ultraviolet light from an irradiation surface 127*b*, the printing medium M on which the ink is discharged, the light shielding plate 18 fixed to the ultraviolet irradiation part 27 and protruding over the irradiation surface 127*b* toward the transport drum 3, the frame 13 configured to support the ultraviolet irradiation part 27, the attaching part 15 fixed to the butting part 215 of the ultraviolet irradiation part 27 so as to be attachable to the frame with an attaching position thereof adjusted, and the guide part 16 attachable to the frame 13, the guide part 16 being configured to guide the adjustment of the attaching position of the attaching part 15 with respect to the frame 13. The guide part 16 includes the first butted part 216A and the second butted part 216B disposed at a position opposite the first butted part 216A, the second butted part 216B being nearer to the transport drum 3 than the first butted part 216A. The butting part 215 is located between the first butted part 216A and the second butted part 216B in the opposing direction D in which the first butted part 216A and the second butted part 216B are opposite each other, and has a width smaller than the spacing G1 between the first butted part 216A and the second butted part 216B and the distance L0 between the irradiation surface 127*b* and the transport drum 3 is a sum of the difference G2 between the width L1 of the butting part 215 and the spacing G1 in the opposing direction D and the protruding length L2 of the light shielding plate 18 from the irradiation surface 127*b*.

Thus, in the printing apparatus 1 of this example, the butting part 215 is disposed in the spacing G1 between the first butted part 216A and the second butted part 216B, and the distance L0 between the irradiation surface 127*b* and the transport drum 3 is the sum of the difference G2 between the spacing G1 and the width L1 of the butting part 215, and the protruding length L2 of the light shielding plate 18 from the irradiation surface 127*b*. In other words, in the printing apparatus 1 of this example, the spacing G1, which is the movement range of the butting part 215 in the opposing direction D, corresponds to the spacing G3 between the light shielding plate 18 and the transport drum 3 and the light shielding plate 18 is fixed to the ultraviolet irradiation part 27, and thus, the ultraviolet irradiation part 27 can be simply and highly accurately positioned by adjusting the spacing G1 to a desired length.

In addition, as described above, in the printing apparatus 1 of this example, the temporary irradiation unit 7 has the same configuration on the first side and the second side in the width direction B, the butting part 215 is provided on both sides of the ultraviolet irradiation part 27 with respect to a center in the longitudinal direction of the ultraviolet irradiation part 27, and the guide part 16 includes the butted part pair 216 including the first butted part 216A and the second butted part 216B and the first butted part 216A on both sides of the ultraviolet irradiation part 27 with respect to the center in the longitudinal direction of the ultraviolet irradiation part 27. Thus, since the ultraviolet irradiation part 27 can be positioned on both sides in the longitudinal direction of the ultraviolet irradiation part 27, skewed positioning of the ultraviolet irradiation part 27 with respect to the transport drum 3 in the longitudinal direction of the ultraviolet irradiation part 27 can be suppressed, and particularly the ultraviolet irradiation part 27 can be highly accurately positioned.

In addition, as illustrated in FIGS. 7 and 8, the temporary irradiation unit 7 in the printing apparatus 1 of this example includes the butting part 215 and the butted part pair 216 at two positions on both the first side and the second side in the width direction B. In other words, in the printing apparatus 1 of this example, the guide part 16 includes the butted part pair 216 including the first butted part 216A and the second butted part 216B at a plurality of locations in the short direction of the ultraviolet irradiation part 27, and the ultraviolet irradiation part 27 includes a plurality of the butting parts 215 corresponding to the butted part pair 216 at the plurality of locations Thus, since the printing apparatus 1 of this example can position the ultraviolet irradiation part 27 at a plurality of locations in the short direction of the ultraviolet irradiation part 27, skewed positioning of the ultraviolet irradiation part 27 with respect to the transport drum 3 in the short direction of the ultraviolet irradiation part 27 can be suppressed, and particularly the ultraviolet irradiation part 27 can be highly accurately positioned.

In addition, as described above, in the printing apparatus 1 of this example, since the light shielding plate 18 is formed entirely along the longitudinal direction of the ultraviolet irradiation part 27 at a position between the irradiation port 127*a* and the head 5 in the short direction of the ultraviolet irradiation part 27, it is possible to effectively reduce the ultraviolet light that reaches the head 5 from the ultraviolet irradiation part 27.

As described above, by using the printing apparatus 1 of this example to perform the first step of fixing the attaching part 15 to the frame 13 with the screw 115 in a state where the light shielding plate 18 is in contact with the transport drum 3, the second step of fixing the guide part 16 to the frame 13 with the screw 116 in a state where the butting part 215 is in contact with the second butted part 216B after the first step, and a third step of fixing the attaching part 15 to the frame 13 with the screw 115 after temporarily releasing the fixing to the frame 13 with the screw 115 to bring the butting part 215 into contact with the first butted part 216A after the second step, the distance L0 between the irradiation surface 127*b* and the transport drum 3 in the opposing direction D can be easily set to the sum of the difference G2 between the width L1 of the butting part 215 and the spacing G1 between the first butted part 216A and the second butted part 216B in the opposing direction D, and a protruding length L2 of the light shielding plate 18 from the irradiation surface 127*b*, and the ultraviolet irradiation part 27 can be simply and highly accurately positioned.

Example 3

Figure 12:
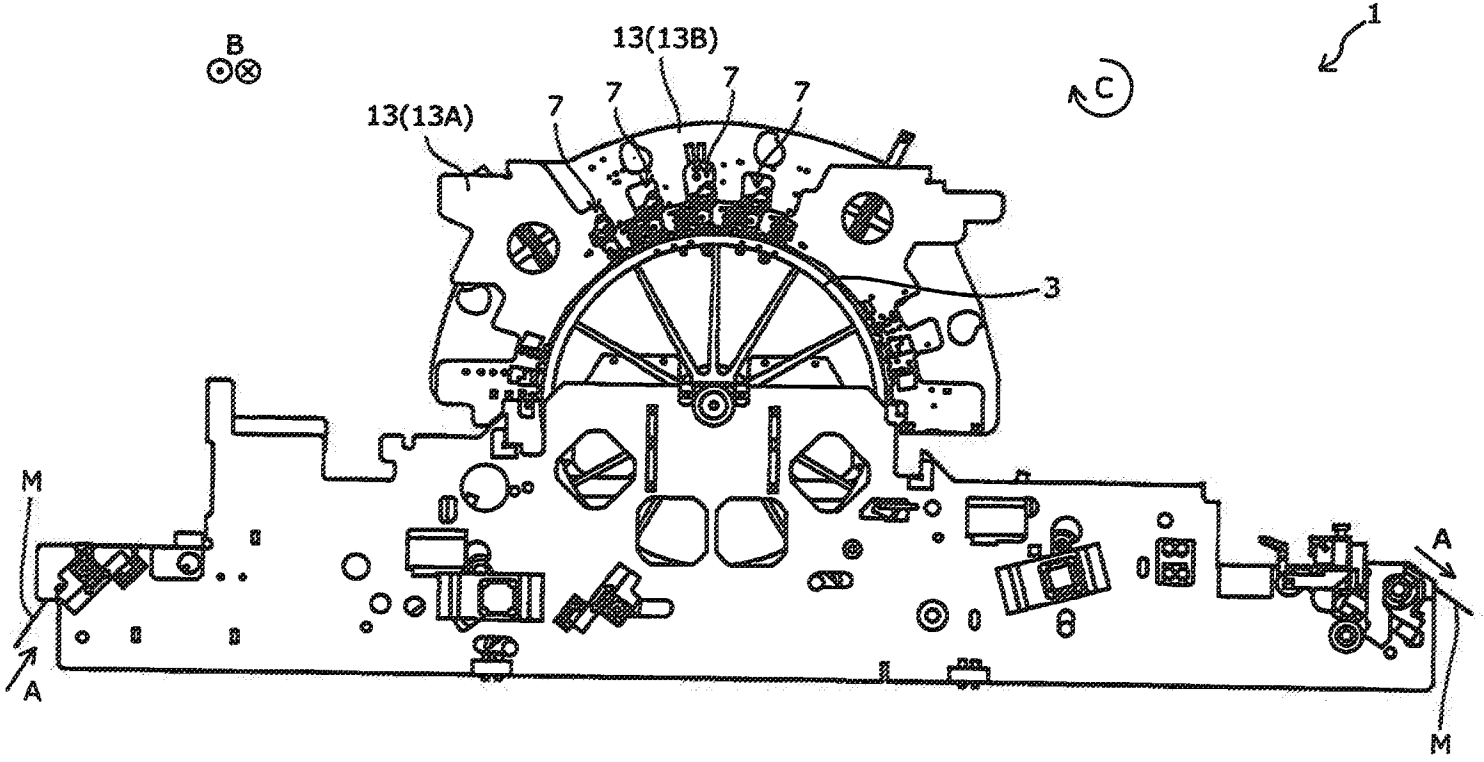
FIG. 12 is a schematic side view of a printing apparatus according to Example 3 of the present disclosure.

Next, the printing apparatus 1 according to Example 3 is described with reference to FIG. 12. Here, as illustrated in FIG. 12, the printing apparatus 1 of this example has the same configuration as the printing apparatus 1 according to Example 2 on one side in the width direction B of the temporary irradiation unit 7, and has the same configuration as the printing apparatus 1 according to Example 1 on the other side in the width direction B of the temporary irradiation unit 7. In addition, the other configurations are the same as the configurations of the printing apparatus 1 according to Example 1 and Example 2. Therefore, the detailed description thereof is omitted.

Specifically, the printing apparatus 1 of this example includes the transport drum 3 that is the supporting part for a printing medium M, the head 5 provided at a position opposite the transport drum 3, the head 5 being configured to discharge ultraviolet-curable ink to the printing medium M, the ultraviolet irradiation part 27 disposed at a position opposite the transport drum 3 such that a longitudinal direction is set as a side opposite to the head 5, the ultraviolet irradiation part 27 including the butting part 215 (first side butting part) on a first side in the longitudinal direction, the ultraviolet irradiation part 27 being configured to irradiate, with ultraviolet light from the irradiation surface 127*b*, the printing medium M on which the ink is discharged, the light shielding plate 18 fixed to the ultraviolet irradiation part 27 and protruding over the irradiation surface 127*b* toward the transport drum 3, the frame 13 configured to support the ultraviolet irradiation part 27, and the attaching part 15 (first side attaching part) provided on the first side in the longitudinal direction of the ultraviolet irradiation part 27, the attaching part 15 being fixed to the first side butting part of the ultraviolet irradiation part 27 so as to be attachable to the frame 13 with an attaching position thereof adjusted, the guide part 16 (first side guide part) provided on the first side in the longitudinal direction of the ultraviolet irradiation part 27, the guide part 16 being attachable to the frame 13 and configured to guide the adjustment of the attaching position of the attaching part 15 with respect to the frame 13, the attaching part 15 (second side attaching part) provided on a second side in the longitudinal direction of the ultraviolet irradiation part 27, the attaching part 15 being fixed to the ultraviolet irradiation part 27 so as to be attachable to the frame 13 through adjustment of the attaching position, and the guide part 16 (second side guide part) provided on the second side in the longitudinal direction of the ultraviolet irradiation part 27, the guide part 16 being attachable to the frame 13 and configured to guide the adjustment of the attaching position of the attaching part 15 with respect to the frame 13. Each of the first side guide part and the second side guide part includes the butted part pair 216 including the first butted part 216A and the second butted part 216B disposed at a position opposite the first butted part 216A, the second butted part 216B being nearer to the transport drum 3 than the first butted part 216A. On the first side in the longitudinal direction of the ultraviolet irradiation part 27, the first side butting part is located between the first butted part 216A and the second butted part 216B in the opposing direction D in which the first butted part 216A and the second butted part 216B are opposite each other, and has a width smaller than the first side spacing that is the spacing (the spacing G1) between the first butted part 216A and the second butted part 216B. On the second side in the longitudinal direction of the ultraviolet irradiation part 27, the attaching part 15 includes the butting part 215 (second side butting part) that is located between the first butted part 216A and the second butted part 216B in the opposing direction D in which the first butted part 216A and the second butted part 216B are opposite each other, the second side butting part having a width smaller than the second side spacing that is the spacing (the spacing G1) between the first butted part 216A and the second butted part 216B. In addition, the first side spacing and the second side spacing are equal to each other, and the difference between the first side spacing and the width of the butting part 215 and the difference between the second side spacing and the width of the second side butting part are equal to each other in the opposing direction D. The distance L0 between the irradiation surface 127*b* and the transport drum 3 is the sum of the difference between the first side spacing and the width of the butting part 215 in the opposing direction (the difference G2 between the spacing G1 and the width L1 of the butting part 215) and the protruding length L2 of the light shielding plate 18 from the irradiation surface 127*b*, and is the sum of the difference between the second side spacing and the width of the second side butting part (the difference G2 between the spacing G1 and the width L1 of the butting part 215) and the protruding length L2 of the light shielding plate 18 from the irradiation surface 127*b*.

Thus, in the printing apparatus 1 of this example, the butting part 215 is disposed in the spacing G1 between the first butted part 216A and the second butted part 216B, and the distance L0 between the irradiation surface 127*b* and the transport drum 3 is the sum of the difference G2 between the spacing G1 and the width L1 of the butting part 215, and the protruding length L2 of the light shielding plate 18 from the irradiation surface 127*b*. In other words, in the printing apparatus 1 of this example, the spacing G1, which is the movement range of the butting part 215 in the opposing direction D, corresponds to the spacing G3 between the light shielding plate 18 and the transport drum 3 and the light shielding plate 18 is fixed to the ultraviolet irradiation part 27, and thus, the ultraviolet irradiation part 27 can be simply and highly accurately positioned by adjusting the spacing G1 to a desired length. In addition, since the ultraviolet irradiation part 27 can be positioned on both sides in the longitudinal direction of the ultraviolet irradiation part 27, skewed positioning of the ultraviolet irradiation part 27 with respect to the transport drum 3 in the longitudinal direction of the ultraviolet irradiation part 27 can be suppressed, and particularly the ultraviolet irradiation part 27 can be highly accurately positioned.

In addition, as described above, in the printing apparatus 1 of this example, since the light shielding plate 18 is formed entirely along the longitudinal direction of the ultraviolet irradiation part 27 at a position between the irradiation port 127*a* and the head 5 in the short direction of the ultraviolet irradiation part 27, it is possible to effectively reduce the ultraviolet light that reaches the head 5 from the ultraviolet irradiation part 27.

In addition, as described above, in the printing apparatus 1 of this example, since the light shielding plate 18 is formed entirely along the longitudinal direction of the ultraviolet irradiation part 27 at a position between the irradiation port 127*a* and the head 5 in the short direction of the ultraviolet irradiation part 27, it is possible to effectively reduce the ultraviolet light that reaches the head 5 from the ultraviolet irradiation part 27.

In the example, the attaching part 15 is fixed to the frame 13 with the screw 115 in the state where the light shielding plate 18 serving as the protrusion is in contact with the transport drum 3; however, in this method, when the thickness of the printing medium M changes, the distance from the surface of the printing medium M to the irradiation surface 127*b* changes in accordance with the thickness of the printing medium M. Therefore, the irradiation intensity of the ultraviolet light emitted from the ultraviolet irradiation part 27 may be correctable in accordance with the thickness of the printing medium M.

Alternatively, the attaching part 15 may be fixed to the frame 13 in the state where the light shielding plate 18 serving as the protrusion is in contact with the printing medium M supported by the transport drum 3. In this case, even when the thickness of the printing medium M in use is changed, the distance from the surface of the printing medium M to the irradiation surface 127*b* can be kept constant at all times.

Note that the present disclosure is not limited to the aforementioned examples, and many variations may be made within the scope of the appended claims, and such variations are encompassed in the scope of the present disclosure.

What is claimed is:

1. A printing apparatus comprising:

a supporting part for a printing medium;

a head disposed at a position opposite the supporting part and configured to discharge ultraviolet-curable ink to the printing medium;

an ultraviolet irradiation part disposed at a position opposite the supporting part such that a longitudinal direction of the ultraviolet irradiation part is a direction along a width of the printing medium, and the ultraviolet irradiation part is configured to irradiate the printing medium on which the ink is discharged with ultraviolet light from an irradiation surface thereof;

a protrusion fixed to the ultraviolet irradiation part and extending past the irradiation surface toward the supporting part;

a frame configured to support the ultraviolet irradiation part; and an attaching position adjustment part that is configured to adjust the attachment position of the ultraviolet irradiation part with respect to the frame in a direction that is substantially perpendicular to the supporting part, the attaching position adjustment part includes a guide part attachable to the frame and configured to guide the adjustment of the attaching position of the ultraviolet irradiation part with respect to the frame, wherein the guide part includes a first butted part and a second butted part which is disposed at a position opposite the first butted part and is closer toward the supporting part than the first butted part, and there is a space between the first butted part and the second butted part, and an attaching part fixed to the ultraviolet irradiation part and attachable to the frame in an attaching position which can be adjusted, wherein the attaching part includes a butting part located between the first butted part and the second butted part, and the butting part has a width smaller than the space between the first butted part and the second butted part; and a distance between the irradiation surface and the supporting part is a sum of (i) a length that the protrusion extends past the irradiation surface and (ii) a difference between the width of the butting part and the space between the first butted part and the second butted part.

2. The printing apparatus according to claim 1, wherein the attaching position adjustment part is provided on both sides of a center in the longitudinal direction of the ultraviolet irradiation part.

3. The printing apparatus according to claim 1, wherein the guide part includes butted part pairs each including the first butted part and the second butted part, at a plurality of locations in a short direction of the ultraviolet irradiation part; and the attaching part includes a plurality of the butting parts correspondingly to the butted part pairs at the plurality of locations.

4. The printing apparatus according to claim 1, wherein the protrusion is formed along the longitudinal direction of the ultraviolet irradiation part at a position between an irradiation opening of the ultraviolet irradiation part and the head in a short direction of the ultraviolet irradiation part.

* * * * *